United States Patent [19]

Barnett et al.

[11] Patent Number: 4,609,380

[45] Date of Patent: Sep. 2, 1986

[54] ABRASIVE WHEELS

[75] Inventors: Scott L. Barnett, Crystal; Gary M. Fariss, Oakdale, both of Minn.

[73] Assignee: Minnesota Mining and Manufacturing Company, Saint Paul, Minn.

[21] Appl. No.: 700,556

[22] Filed: Feb. 11, 1985

[51] Int. Cl.[4] ..... C09K 3/14

[52] U.S. Cl. ..... 51/298; 51/295

[58] Field of Search ..... 51/298, 295

[56] References Cited

U.S. PATENT DOCUMENTS

| | | | |
|---|---|---|---|
| 2,885,276 | 5/1959 | Upton, Jr. | 51/298 |
| 2,958,593 | 11/1960 | Hoover et al. | 51/295 |
| 4,227,350 | 10/1980 | Fitzer | 51/295 |
| 4,331,453 | 5/1982 | Dau et al. | 51/298 |
| 4,350,497 | 9/1982 | Ogman | 51/298 |

*Primary Examiner*—Paul Lieberman
*Assistant Examiner*—Willie J. Thompson
*Attorney, Agent, or Firm*—Donald M. Sell; James A. Smith; Richard Francis

[57] ABSTRACT

An abrasive wheel comprised of abrasive granules dispersed throughout and adhered in a matrix with a binder system which comprises a blend of a tough adherent binder and a smear-reducing quantity of a smear-reducing compatible polymer. An abrasive wheel having abrasive granules adhered by the binder without the compatible polymer has a tendency to smear onto the surface of a workpiece when rotated thereagainst under heat-generating conditions such as high wheel to workpiece pressure and surface speed.

11 Claims, No Drawings

ABRASIVE WHEELS

TECHNICAL FIELD

The present invention relates to abrasive wheels formed of abrasive granules dispersed throughout and adhered in a matrix with organic binder.

BACKGROUND ART

Rotatable abrasive wheels formed of abrasive granules dispersed in and bonded to an organic polymeric matrix formed of a solid or foamed organic polymer or a nonwoven fiber web are well known and widely used. These wheels find utility in deburring and finishing articles such as cast, drilled or punched parts and the like. Burrs and flashing from such parts must be removed to produce a desired shape or surface finish. Small diameter wheels operating at high speeds and high pressures are especially useful. To meet the performance requirements, the wheels or discs must have sufficient strength, be durable and not collapse when subjected to high use pressure against the workpiece or part and not smear.

Examples of abrasive products including a matrix of solid or foamed organic polymer are disclosed by Upton U.S. Pat. No. 2,885,276. Examples of products which contain a matrix formed of a lofty, low density nonwoven web are disclosed by Hoover et al U.S. Pat. No. 2,958,593 and Fitzer U.S. Pat. No. 4,227,350, both assigned to the assignee of the present application.

Polymeric resinous binders used to secure the abrasive granules within the matrix of such products have generally been either of the hard thermosetting type or the strong, tough elastomeric type. Hard thermosetting resins, such as base catalyzed phenol formaldehyde, are widely used to secure abrasive granules to sheet-like backings or to the fibers of a nonwoven web matrix. Such hard resin binders, while usually having high tensile strength, low elongation at break or failure, and resistance to significant change when subjected to elevated temperatures, are undesirably susceptible to brittle fracture. Strong, tough elastomeric resin binders, examples of which are disclosed by Fitzer U.S. Pat. No. 4,227,350, are more desirable in certain applications which require tougher, more durable abrasive products. Such elastomeric binders have excellent tensile strength, a very high elongation at break, and resistance to brittle fracture but, unfortunately, they show significant softening at elevated temperatures as might be encountered when abrasive products are urged against a workpiece at high speeds and pressures. Such softening often results in the undesirable smearing or transfer of portions of the abrasive article to the surface of the workpiece.

SUMMARY OF THE PRESENT INVENTION

The invention provides abrasive articles, preferably in the form of a wheel, which can be urged against a workpiece at high pressure and high speed with little or no undesirable wheel surface smearing or transfer to the workpiece surface.

The present invention provides an abrasive wheel which comprises abrasive granules dispersed throughout and adhered in an organic matrix with a novel binder system comprising a blend of binder and a smear-reducing quantity of a smear-reducing compatible polymer. The blend preferably has a glass transition temperature of at least 40° C., most preferably 50° C. The smear-reducing compatible polymer may be obtained by introducing a reactive material such as a solid or a liquid which either forms a homopolymer, a copolymer with other ingredients in the binder system, or other reaction product. Most preferably the compatible polymer is introduced in its polymerized state. Such polymers preferably have a glass transition temperature of at least 50° C.

The binder has an initial liquid state and is curable to a tough adherent polymeric material. The binder will firmly adhere the abrasive granules in the matrix of the wheel, but, when the wheel is rotated against a workpiece under heat-generating conditions such as high wheel to workpiece pressure and surface speed, it commonly will cause surface portions of the wheel to smear onto the surface of the workpiece. The addition of the compatible polymer significantly reduces or eliminates smearing.

Preferred abrasive wheels also include in the binder system lubricating amounts of conventional lubricant (of the type typically used in abrasive wheels) to further reduce smearing.

As used herein in describing the binder, "liquid state" refers to a softened state to provide a coatable composition. Such a state may be obtained by melting, forming a solvent solution, a combination of these, and the like. The term "blend" refers to a substantially uniform mixture or reaction product of the binder and compatible polymer. The term "curable" refers to hardening to a substantially tough, tack-free condition, e.g., by cooling a melted material, solvent evaporation of a solvent-/polymer solution, crosslinking, and the like. The term "compatible" refers to the ability of the binder and the polymer to combine substantially uniformly without gross phase separation. In a compatible binder and polymer combination the square root of the difference between the cohesive energy density of the binder and that of the polymer will be less than about 1 as defined by H. Mark and A. V. Tobolsky, Physical Chemistry of High Polymers, Vol. II, page 260.

DETAILED DESCRIPTION

The abrasive products of the present invention may take any of a variety of conventional forms. The preferred products according to the present invention are in the form of wheels. Such wheels are typically in the form of a disc or right cylinder having dimensions which may be very small, e.g., a cylinder height on the order of one centimeter, or very large, e.g., two meters or more, and a diameter which may be very small, e.g., on the order of a few centimeters, or very large, e.g., one meter or more. The wheels typically have a central opening for support by an appropriate arbor or other mechanical holding means to enable the wheel to be rotated in use. Wheel dimensions, configurations, means of support, and means of rotation are well known in the prior art.

The matrix may be either a solid or foamed organic polymer or a nonwoven fibrous web. Such matrices are also well known in the prior art. An example of a lofty, nonwoven fibrous matrix formed of crimped staple fibers adhered at points of contact with binder which contains abrasive particles is taught in Hoover et al U.S. Pat. No. 2,958,593. Fitzer U.S. Pat. No. 4,227,350 discloses a matrix formed of three-dimensionally undulated inter-engaged autogenously bonded continuous filaments. The disclosures of these patents are incorporated herein by reference.

The abrasive products of the present invention may be prepared by appropriate techniques which are also well known in the prior art. For example, a wheel shape may be die cut from a slab of the abrasive material. Additionally, ribbons, strips, or elongate segments of the abrasive material may be spirally wound into a wheel shape while the binder system is uncured or partially cured and then cured to yield a wheel. Furthermore, uncured or partially cured webs can be cut into sheets or discs which are stacked on one another and then compressed and cured under compression to make a higher density abrasive product. Such formation techniques are well known in the prior art.

Preferred abrasive products according to the present invention include a binder system which has an inner or under portion of hard thermosetting resin or strong, tough elastomeric resin with an outer or surface coating, sometimes called a "size" coating, of the blend of binder with smear-reducing compatible polymer as herein described. Fiber or filament web-containing products usually include a first binder coating which produces an inner portion of elastomeric resin and a second or "size" coating thereover to produce an outer portion of elastomeric resin. The outer portion of binder is typically at least half the total binder weight. The entire binder system may consist essentially of the blend. The latter situation is generally the case where the matrix consists of a foamed or solid block of polymer.

The tough, adherent elastomeric resinous binder is preferably of high molecular weight, and solvent soluble or thermosetting and, in the unmodified, cured or dried state, preferably has an ultimate tensile strength of at least $20\times10^6$ Pa and an elongation at break of at least 100%.

These physical properties of the binder may be reduced somewhat by the addition of the compatible polymer and/or lubricant, if used, but, even with such decrease, the binder adequately performs its function in adhering the abrasive granules to the matrix.

A preferred example of a high molecular weight solvent soluble tough, adherent binder is a thermoplastic polyester polyurethane available under the trade designation "Estane" 5703 from the B. F. Goodrich Company. Examples of tough, adherent elastomeric thermosetting resinous binders are isocyanate terminated polyethers or polyesters which are reacted with polyfunctional active hydrogen curatives. Preferred thermosetting systems are aliphatic or aromatic isocyanate-terminated polybutylene glycol polymers cured with aromatic diamines. Examples of preferred diisocyanate polymers are available under the trade designation "Adiprene" L-100, L-167, and L-315, available from Uniroyal Corporation. Preferably, these isocyanate-terminated polymers are blocked with a blocking agent such as 2-butanone oxime. Examples of preferred aromatic diamines are bis (4-aminophenyl) methane (hereinafter referred to as "MDA") and bis (2-chloro-4-aminophenyl) methane.

The preferred compatible smear-reducing polymer is a medium to higher molecular weight polymeric material which is compatible, as previously described, with the binder. Preferred compatible polymers have a glass transition temperature above about 50° C. The compatible polymer may be reactive with the binder of the binder system or it may merely be in a physical mixture with it. The molecular weight of the compatible polymer is typically above about 2000. Examples of useful compatible polymers include a phenoxy resin sold under the trade designation "UCAR" Phenoxy PKHH resin by the Union Carbide Chemical Corporation, an epoxy resin based upon bisphenol A sold under the trade designation "Epon" 1007F by the Shell Chemical Company, a medium molecular weight partially hydrolyzed vinyl chloride/vinyl acetate copolymer sold under the trade designation "UCAR" VAGH-1 by Union Carbide Chemical Corporation, and styrene and allyl alcohol copolymer sold under the trade designation "RJ-100"by the Monsanto Polymers and Petro Chemical Company.

As previously mentioned, the compatible polymer may be obtained by introducing a reactive material such as a liquid which polymerizes or otherwise reacts in the binder system. An example of such a reactive material is bis-phenol A diglycidyl ether (a liquid polymerizable oligomer available under the trade designation "Epon" 828 from the Shell Chemical Company). Other solid or liquid reactive materials polymerizable in the binder system to produce the smear-reducing properties are also useful.

The blend of polymer and tough adherent binder should have a glass transition temperature of at least about 40° C., preferably at least about 50° C. Abrasive articles made with the blend have a decreased propensity to smear directly related to the amount of compatible polymer in the blend. Preferred blends include at least 10% by weight compatible polymer. Most preferably, the blend comprises from about 20 to 50% by weight of the compatible polymer.

The binder system and the blend may contain conventional lubricants of the type presently used in abrasive products to further reduce smearing. While such lubricants are known to reduce smearing somewhat, wheels containing a binder system with both the compatible polymer and the conventional lubricant have an unexpectedly improved resistance to smearing over wheels with the binder system containing lubricant alone. Examples of conventional lubricants include metal stearate salts such as lithium stearate, molybdenum disulfide, and the like.

The abrasive granules employed to produce the abrasive products of the present invention may be any known abrasive material commonly used in the abrasive art. The abrasive granule size and type may be any of those commonly used to make abrasive wheels. It is well within the skill of the art to select the appropriate abrasive material, once being apprised of the disclosure herein of the present invention.

The invention is further illustrated by the following non-limiting examples, wherein all parts are by weight unless otherwise specified.

EXAMPLE 1

A 15 mm thick low density non-woven web weighing 80 g/m$^2$ was formed from 13 denier nylon 6-6 fibers on a web-forming machine available under the trade designation "Rando Webber". The resulting low density web was roll coated with a prebond resin to provide a dry add on weight of 45 g/m$^2$ using a coating solution consisting of 39.3% xylol, 16.1% of a solution of 35 parts methylene dianiline (MDA) and 65 parts 2-ethoxy ethanol acetate, 44.6% ketoxime-blocked poly-1,4-butylene glycol diisocyanate having a molecular weight of about 1500 (sold under the trade designation "Adiprene BL- 16"by Uniroyal Corporation), and a trace of a silicone defoamer. The prebond resin was cured to a non-tacky condition by passing the coated web through a convection oven maintained at 150° C. for a residence time of about 7 minutes. The resultant prebonded nonwoven web was about 10 mm thick and weighed about 126 g/m$^2$.

An adhesive binder consisting of 39.8% diethylene glycol monoethyl ether, 59% of a base catalyzed phenolformaldehyde resin having 70% non-volatiles, 1.2% of an aqueous sodium hydroxide solution (NaOH:-$H_2O$1:1), and 0.06% of fluorochemical surfactant (available from the Minnesota Mining and Manufacturing Company under the trade designation "FC 170") was roll coated at the rate of 54 g/m$^2$ dry onto the prebonded web described above. The wet adhesive coated web was coated uniformly throughout with 100 grit (average particle size 140 micrometers) silicon carbide abrasive granules at the rate of 815 g/m$^2$ by dispersing the abrasive granules in an air stream which was simultaneously directed onto the web's major surfaces.

TABLE I

| Components | Size Adhesive, % by Weight | | | | | | | |
|---|---|---|---|---|---|---|---|---|
| | A | B | C | D | E | F | G | H |
| Blocked Adiprene L 315[1] | 52.7 | 40.9 | 36.4 | 31.8 | 34.5 | 36.2 | 35.1 | 40.4 |
| 4,4'-methylene bis aniline (MDA) | 8.0 | 6.2 | 5.5 | 4.8 | 5.3 | 5.5 | 4.5 | 6.1 |
| Lithium stearate | 5.2 | 4.5 | 4.5 | 4.5 | 4.5 | 4.5 | 4.4 | — |
| Xylol | 14.1 | 20.8 | 11.1 | 1.4 | 7.4 | 11.1 | 7.0 | 6.3 |
| Methyl ethyl ketone | — | — | — | — | — | 24.3 | — | — |
| 2-Ethoxy ethanol acetate | 20.0 | 23.5 | 34.4 | 45.2 | 38.6 | 10.3 | 38.8 | 38.2 |
| "UCAR" Phenoxy resin PKHH[2] | — | 4.1 | 8.1 | 12.3 | — | — | — | 9.0 |
| "Epon" 1007F[3] | — | — | — | — | 9.7 | — | — | — |
| "UCAR" VAGH-1[4] | — | — | — | — | — | 8.1 | — | — |
| "RJ"-100 SAA[5] | — | — | — | — | — | — | 10.2 | — |
| Percent additive[6] | 0 | 10 | 20 | 30 | 20 | 20 | 20 | 20 |

[1]Contains 74.1% "Adiprene" L 315, available from Uniroyal, blocked by adding 14.8% 2-butanone oxime and 11.1% 2-ethoxy ethanol acetate.
[2]Phenoxy resin having a molecular weight of 30,000 available from Union Carbide Chemical Corporation.
[3]Epoxy resin available from Shell Chemical Company.
[4]A medium molecular weight partially hydrolyzed vinyl chloride, vinyl acetate resin available from Union Carbide Chemical Corporation.
[5]Available from Monsanto Polymers & Petrochemical Company and is a copolymer of styrene and allyl alcohol.
[6]Percent additive by weight of "UCAR", phenoxy PKHH, "Epon" 1007F, "UCAR" VAGH, or "RJ"-100 based upon solids weight of "Adiprene" L 315 and MDA.

Segments of the abrasive coated web were then roll coated with the size binder resin using size resins identified "A"-"H" in Table I to produce adhesive-sized webs. The size resins were coated onto the abrasive coated web at the dry add on rate of 32%, 24%, or 16% based upon the weight of the abrasive coated web. Each size resin-coated abrasive web was passed through a convection oven maintained at 70° C. for a residence time of approximately 4 minutes to partially dry and remove all but about 8.5% of the volatiles, based on the coated web final dry weight.

Four 305 mm square segments of partially dried size resin-coated web, with the same type size resin, were assembled and the assembly placed in a platen press heated at 135° C., compressed to 6 mm, and then held for 15 minutes to produce an abrasive slab. Each partially cured slab was removed from the press and cured further in a convection air oven for 90 minutes at 135° C. After allowing the cured slabs to cool to room temperature, wheels having a 75 mm diameter and 9.5 mm center hole were die cut from the 6 mm thick slabs.

The wheels, identified in Table III as Examples 2-17, were evaluated for smearing or transfer of materials from the wheel to a test workpiece. The wheels were mounted on the arbor of an air powered tool which was rotated at 18,000 revolutions per minute. The tool was stationarily supported and loaded to force the wheel against the test workpiece. The rotating wheel was forced at 35.6N against a 60 mm by 300 mm titanium metal plate which was mounted on a traversing table that moved, causing the wheel to make a 200 mm long path on the metal plate at the rate of 25 mm per second. The amount of material transfered from the test wheel was observed and rated according to the scale given in Table II.

TABLE II

| Rating | Observation |
|---|---|
| 1 | No transfer |
| 2 | Very slight transfer |
| 5 | Significant and objectionable transfer |
| 8 | Large amounts of transfer |
| 10 | Gross amounts of transfer |

The results of the smear test described above, the relative amount of size adhesive (%), the glass transition temperature (Tg) of the size adhesive material contained in the abrasive article as measured by Dynamic Mechanical Analysis according to the method described in ASTM D 4065-82, with the Tg being reported as the temperature at which a maximum value of the ratio of lost to stored energies (Tan δ) occurs during transition to the elastomeric state. The relative amount (%) and type of additive polymer, and the size adhesive (A-H) are reported in Table III.

TABLE III

| Ex. No. | Size Adhesive | Type Additive | Amount (%) | Tg, °C. | Size Adhesive Add-on, (%) | Transfer Test |
|---|---|---|---|---|---|---|
| 2 | A | None | 0 | −25 | 32 | 10 |
| 3 | A | " | " | " | 24 | 8 |
| 4 | A | " | " | " | 16 | 7 |
| 5 | B | Phenoxy PKHH | 10 | 100 | 32 | 6 |
| 6 | B | " | " | " | 24 | 5 |
| 7 | B | " | " | " | 16 | 4 |

TABLE III-continued

| Ex. No. | Size Adhesive | Type Additive | Amount (%) | Tg, °C. | Size Adhesive Add-on, (%) | Transfer Test |
|---|---|---|---|---|---|---|
| 8 | C | " | 20 | 96 | 32 | 3 |
| 9 | C | " | " | " | 24 | 2 |
| 10 | C | " | " | " | 16 | 1 |
| 11 | D | " | 30 | 85 | 32 | 1 |
| 12 | D | " | " | " | 24 | 1 |
| 13 | D | " | " | " | 16 | 1 |
| 14 | E | "Epon" 1007F | 20 | 95 | 24 | 2 |
| 15 | F | "UCAR" VAGH | 20 | 82 | 24 | 2 |
| 16 | G | "RJ"-100 | 20 | 86 | 24 | 4 |
| 17 | H | Phenoxy PKHH | 20 | 100 | 24 | 5 |

Tensile strength and elongation at break were measured for some of the size adhesives. These values are given in Table IV. Size adhesive compositions A, C, E, F, G, H were prepared according to the compositions given in Table I except lithium stearate was omitted from all but H. Test size adhesive compositions were coated to produce a 0.3 mm cured film on a glass plate that had been previously coated with a release agent. The release agent-coated glass plates were prepared by coating the glass with an aqueous solution of polyvinyl alcohol which was allowed to air dry. The size adhesive compositions were cured for 120 minutes at 135° C., then immersed while on the glass plate in water for a short time to release the cured film. The tensile strength and elongation at break were measured according to ASTM D 412-80. Table IV reveals the results.

TABLE IV

| Size Adhesive | Tensile Strength $10^6$ Pa | Elongation (%) |
|---|---|---|
| A | 62.0 | 210 |
| C | 40.0 | 160 |
| E | 46.2 | 160 |
| F | 35.2 | 170 |
| G | 38.6 | 140 |
| H | 11.7 | 10 |

The glass transition temperature of the additives used in the size resins listed in Table I are given in Table V below. The glass transition temperatures were measured by Differential Scanning Calorimetry following the method of ASTM D 3418-75.

TABLE V

| Additive | Tg (°C.) |
|---|---|
| Phenoxy PKHH | 100 |
| "Epon" 1007F | 74 |
| "UCAR" VAGH | 65 |
| "RJ"-100 SAA | 67 |

EXAMPLES 18–27

Films of methylene dianiline cured isocyanate-terminated polyalkylene ether glycol which contained various levels of polymer additive were evaluated for glass transition temperature, (Tg), tensile strength, and elongation at break. These films were prepared by combining 2.89 parts "Adiprene" BL 16 and 1 part of a 35% solution of methylene dianiline in 2-ethoxy ethanol acetate. The calculated $NCO:NH_2$ ratio was 1.08:1. The percent polymer additive, if used, was based upon nonvolatile content of "Adiprene" BL 16 and methylene dianiline. Sufficient amount of a prepared mixture was poured onto a release agent-coated glass plate to produce a 0.3 mm thick cured film. The mixtures were cured for 120 minutes at 135° C. The cured polymer films were removed and the glass transition temperature was measured per ASTM D 4065-82 and tensile strength-elongation per ASTM D 412-80. Table VI summarizes the results.

TABLE VI

| Ex. No. | Polymer Additive Tradename | Amount (%) | Tg (°C.) | Tensile Strength $10^6$ Pa | Elongation at Break (%) |
|---|---|---|---|---|---|
| 18 | None | — | −35 | 44.1 | 460 |
| 19 | Phenoxy PKHH | 14 | 50 | 48.3 | 350 |
| 20 | Phenoxy PKHH | 20 | 86 | 45.5 | 440 |
| 21 | Phenoxy PKHH[1] | 20 | 85 | 13.8 | 130 |
| 22 | Phenoxy PKHH | 50 | 98 | 40.0 | 150 |
| 23 | "Epon" 1007F | 24 | 42 | 50.1 | 380 |
| 24 | "Epon" 1007F[1] | 23.8 | 42 | 9.6 | 70 |
| 25 | "RJ"-100 SAA | 20 | 34 | 16.5 | 470 |
| 26 | "RJ"-100 SAA[2] | 25 | 46 | 42.1 | 430 |
| 27 | "UCAR" VAGH | 17 | 52 | 45.5 | 390 |

[1]Lithium stearate added at 10 parts to 100 parts polymer solids, by weight.
[2]The calculated —NCO/—$NH_2$ ratio was changed to 1.28/1.00.

EXAMPLES 28–30

The glass transition temperature of a thermoplastic polyester polyurethane with and without compatible polymer additive was evaluated according to ASTM D 4065-82. A thermoplastic polyester polyurethane commercially available from B. F. Goodrich and Company under the trade designation "Estane" 5703 was dissolved in 2-ethoxy ethanol acetate to provide a 25% solution. Separately, either "Epon" 1007F or Phenoxy PKHH was added as 25% solutions in 2-ethoxy ethanol acetate to the "Estane" 5703/2-ethoxy ethanol acetate solution to produce a mixture having equal parts by weight of "Estane" 5703 and polymer additive. A sufficient amount of these mixtures were poured on a release agent-coated glass plates, as previously described, dried at 135° C. for 120 minutes, removed and tested. Table VII summarizes the results.

TABLE VII

| Example | Polymer Additive | Tg (°C.) |
|---|---|---|
| 28 | None | −6 |
| 29 | "Epon" 1007F | 48 |
| 30 | Phenoxy PKHH | 43 |

EXAMPLE 31 and CONTROL A

Using a two-roll rubber mill with rolls internally heated with 130° C. steam was milled in the amounts shown in Table VIII below solid thermoplastic polyurethane (available under the trade designation "Estane" 5703), 30,000 molecular weight phenoxy resin available under the trade designation PKHH, lithium stearate lubricant, and grade 180/240 (average particle size range 46–67 micrometers) silicon carbide abrasive granules until the resultant 3.22 mm slabs appeared to be homogenous. The glass transition temperatures of the slab were measured per ASTM 4065-82.

TABLE VIII

| Components | Example 31 | Control A |
|---|---|---|
| "Estane" | 200 | 200 |
| Phenoxy PKHH | 50 | — |
| Lithium Stearate | 25 | 20 |
| 180/240 Grade Silicon Carbide | 1315 | 1070 |
| Glass Transition Temperature | 33° C. | −12° C. |

Two 75 mm diameter wheels were cut from each slab of each of Example 31 and Control Example A. The two wheels from the same slab were combined by heating and pressing for 40 minutes in heated press at 150° C., producing wheels about 6.3 mm thick. When evaluated for smearing, the wheel of Example 31, which contained the phenoxy resin, showed a very low smearing while the wheel of Control Example A smeared profusely.

EXAMPLES 32–39, CONTROL B AND CONTROL C

Blocked "Adiprene" L-315 and "Adiprene" BL-16 were separately cured with MDA where the ratio of —NCO: —$NH_2$ was 1.08:1. Various amounts of "Epon" 828, a bisphenol A diglycidyl ether (available from Shell Chemical Company), were added to these "Adiprene" -MDA mixtures prior to curing. After being combined at room temperature, the mixtures were poured onto release agent coated glass plates and cured 2 hours at 135° C. Table IX reports the amount of "Epon" 828 added based upon the combined weight of the "Adiprene" and MDA and the glass transition temperature of the cured polymer mixtures as measured by ASTM D 4065-82.

TABLE IX

| Example | "Adiprene" | Parts Polymer | Parts "Epon" 828 | Tg° C. |
|---|---|---|---|---|
| Control B | L-315 | 6 | None | −20 |
| 32 | " | 6 | 1 | 83 |
| 33 | " | 4 | 1 | 76, 90* |
| 34 | " | 3 | 1 | 58, 81* |
| 35 | " | 2 | 1 | 56, 79* |
| Control C | BL-16 | 6 | None | −25 |
| 36 | " | 6 | 1 | 62 |
| 37 | " | 6 | 1 | 57 |
| 38 | " | 4 | 1 | 56 |
| 39 | " | 2 | 1 | 52 |

*Visual examination showed the presence of two phases in Examples 33, 34 and 35. The Tg of each phase is reported.

We claim:

1. An abrasive wheel comprising:
(a) a matrix of organic material;
(b) abrasive granules dispersed throughout and adhered in said matrix; and
(c) a binder system adhering said abrasive granules in said matrix, said binder system comprising a blend of:
(1) binder having an initial liquid state and being curable to a tough adherent polyurethane material which in the unmodified state will firmly adhere said abrasive granules in said matrix of said wheel but, when said wheel is rotated against a workpiece under heat-generating conditions such as high wheel to workpiece pressure and surface speed, may smear onto the surface of the workpiece; and
(2) sufficient smear-reducing quantity of a smear-reducing compatible polymer having a glass transition of at least 50° C. to endow the blend with a glass transition of at least 40° C.

2. The abrasive wheel of claim 1 wherein said compatible polymer has a molecular weight of at least about 2000.

3. The abrasive wheel of claim 1 wherein said compatible polymer is selected from the group consisting of phenoxy resin, epoxy resin, hydroxyl-terminated polyvinyl chloride resin, styrene allyl alcohol copolymer, and mixtures thereof.

4. The abrasive wheel of claim 1 wherein said tough adherent polymeric material has tensile strength of at least about $20\times10^6$ Pa and elongation at break of at least about 100%.

5. The abrasive wheel of claim 1 wherein said binder system contains a lubricating amount of conventional lubricant.

6. The abrasive wheel of claim 1 wherein said matrix is an open, lofty, nonwoven, fibrous matrix.

7. The abrasive wheel of claim 1 wherein said smear-reducing quantity is at least about 10% by weight based on the total weight of the cured binder system.

8. The abrasive wheel of claim 7 wherein said smear-reducing quantity is from about 20 to 50% by weight.

9. The abrasive wheel of claim 1 wherein said binder system consists essentially of said blend.

10. An abrasive wheel comprising:
(a) a matrix of organic material;
(b) abrasive granules dispersed throughout and adhered in said matrix; and
(c) a binder system adhering said abrasive granules in said matrix, said binder system comprising a copolymer having a glass transition temperature of at least 40° C. formed of:
(1) a first monomeric material which will polymerize to form a tough adherent polymeric material which will firmly adhere the abrasive granules in said matrix of said wheel but, when said wheel is rotated against a workpiece under heat-generating conditions such as high wheel to workpiece pressure and surface speed, may smear onto the surface of the workpiece;
(2) a second monomeric material, polymerizable with said first monomeric material, in a sufficient quantity and of a type to endow said copolymer with a glass transition temperature of at least 40° C.

11. The abrasive wheel of claim 10 wherein said second monomeric material is a bisphenol A diglycidyl ether.

* * * * *